US007077982B2

(12) United States Patent
Kinoshita et al.

(10) Patent No.: US 7,077,982 B2
(45) Date of Patent: Jul. 18, 2006

(54) MOLECULAR ELECTRIC WIRE, MOLECULAR ELECTRIC WIRE CIRCUIT USING THE SAME AND PROCESS FOR PRODUCING THE MOLECULAR ELECTRIC WIRE CIRCUIT

(75) Inventors: Takatoshi Kinoshita, Aichi (JP); Shintaro Washizu, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 505 days.

(21) Appl. No.: 10/103,757

(22) Filed: Mar. 25, 2002

(65) Prior Publication Data

US 2002/0139961 A1 Oct. 3, 2002

(30) Foreign Application Priority Data

Mar. 23, 2001 (JP) ..... 2001-086315

(51) Int. Cl.
*H01B 1/00* (2006.01)
*H01C 1/00* (2006.01)

(52) U.S. Cl. ..... 252/500; 252/511; 252/301.17; 257/22; 257/23; 257/40; 435/5; 438/1

(58) Field of Classification Search ..... 252/500, 252/511, 301.14; 257/23, 40; 435/6; 436/518; 327/365
See application file for complete search history.

(56) References Cited

U.S. PATENT DOCUMENTS

| | | | | |
|---|---|---|---|---|
| 3,979,184 A | | 9/1976 | Giaever | |
| 3,985,617 A | | 10/1976 | Yugari et al. | |
| 4,350,761 A | | 9/1982 | Yamamoto | 435/7.93 |
| 4,592,980 A | | 6/1986 | Tomida et al. | 430/59.1 |
| 4,796,981 A | | 1/1989 | Nishimura et al. | 359/289 |
| 4,810,639 A | | 3/1989 | Pankratz | 435/7.4 |
| 4,819,239 A | | 4/1989 | Sharp et al. | 372/12 |
| 4,828,917 A | | 5/1989 | Wegner et al. | 428/333 |
| 4,868,105 A | | 9/1989 | Urdea et al. | 435/6 |
| 4,909,990 A | | 3/1990 | Block et al. | 422/82.11 |
| 4,933,285 A | * | 6/1990 | Patton | 435/181 |
| 5,063,417 A | * | 11/1991 | Hopfield | 257/40 |
| 5,246,748 A | | 9/1993 | Gillberg-Laforce et al. | 428/1.2 |
| 5,281,539 A | | 1/1994 | Schramm | 204/403.11 |
| 5,304,631 A | | 4/1994 | Stewart et al. | |
| 5,354,654 A | | 10/1994 | Ligler et al. | 435/5 |
| 5,756,296 A | * | 5/1998 | Cubicciotti | 435/6 |

(Continued)

FOREIGN PATENT DOCUMENTS

EP 1 288 662 A1 3/2003

(Continued)

OTHER PUBLICATIONS

Cooper et al, "Formation of Polypeptide-Dye Multilayers by an Electrostatic Self-Assembly Technique," Langmuir, 1995, 11, pp. 2713-2718.*

(Continued)

*Primary Examiner*—Mark Kopec
*Assistant Examiner*—Kallambella Vijayakumar
(74) *Attorney, Agent, or Firm*—Sughrue Mion, PLLC

(57) ABSTRACT

A molecular electric wire that is formed of an environmentally benign ecological material and enables a microscopic wiring, a molecular electric wire circuit using the molecular electric wire, and the like are provided. The molecular electric wire comprises a rod-shaped organic molecule and an electroconductive material, the electroconductive material being carried by the rod-shaped organic molecule, and the molecular electric wire circuit is formed by using the molecular electric wire.

9 Claims, 3 Drawing Sheets

U.S. PATENT DOCUMENTS

| | | | | |
|---|---|---|---|---|
| 5,759,447 | A | 6/1998 | Efron et al. | 252/582 |
| 5,766,784 | A | 6/1998 | Baskaran et al. | 428/702 |
| 5,783,392 | A | 7/1998 | Seibl et al. | 435/6 |
| 5,800,994 | A | 9/1998 | Martinelli | 435/6 |
| 6,083,689 | A | 7/2000 | Martinelli et al. | 435/6 |
| 6,087,100 | A * | 7/2000 | Meade et al. | 435/6 |
| 6,096,273 | A * | 8/2000 | Kayyem et al. | 422/68.1 |
| 6,124,963 | A | 9/2000 | Schumaker | 359/245 |
| 6,238,864 | B1 | 5/2001 | Yan | 435/6 |
| 6,248,539 | B1 | 6/2001 | Ghadiri et al. | |
| 6,261,152 | B1 | 7/2001 | Aiyer | |
| 6,306,584 | B1 * | 10/2001 | Bamdad | 435/6 |
| 6,400,489 | B1 * | 6/2002 | Suzuki et al. | 359/241 |
| 6,451,543 | B1 | 9/2002 | Kochendoerfer et al. | 435/7.1 |
| 6,686,150 | B1 | 2/2004 | Blackburn et al. | 435/6 |
| 6,699,667 | B1 * | 3/2004 | Keen | 435/6 |
| 2003/0179381 | A1 | 9/2003 | Kinoshita et al. | |

FOREIGN PATENT DOCUMENTS

| | | |
|---|---|---|
| GB | 2 245 971 A1 | 1/1992 |
| JP | 63-222248 | 9/1988 |
| JP | 04-009743 | 1/1992 |
| JP | 07/075598 | 3/1995 |
| JP | 7-509565 | 10/1995 |
| JP | 9-512345 | 12/1997 |
| JP | 11-183479 | 7/1999 |
| JP | 2000-2499644 | 9/2000 |
| WO | WO 94/03774 | 2/1994 |
| WO | WO 96/26435 | 8/1996 |
| WO | WO 01/12665 A2 | 2/2001 |

OTHER PUBLICATIONS

Kinoshita et al, "The guest-induced oscillation of a monolayer composed of polypeptide containing beta-clycodextrin at the terminal," Chaos, 1999, 9(2), pp. 276-282.*

Greenham et al, "Charge seperation and transport in conjugated-polymer/semiconductor-nanocrystal composites studied by photoluminescence quenching and photoconductivity," Physical Review-B, 1996,54(24), pp. 17628-17637.*

Color Tone Control By External Stimuli, Nagoya Institute of Technology, Imitating Function of Bio-skins Applicable to Display Devices, *Nikkan Kogyo Shinbun*, Dec. 28, 2000, Japan.

T. Doi et al., Symposium: Building of Molecular Composition and Its Function, Building and control of peptide type signal transfer function. A506. Nagoya Institute of Technology, Symposium held by JST, Nov. 28, 2000. Japan.

H. Yokoi et al., Preparation of Amphiphilic α-helix LB film, *Polymer Preprints, Japan*, vol. 49 No. 12 IS07, Nagoya Institute of Technology, 2000, Society of Polymer Science, Japan.

H. Yokoi et al., Evaluation of molecular orientation of amphiphilic αhelix water surface monomolecular film. *Polymer Preprints, Japan*. vol. 49 No. 13 lipd090, Nagoya Institute of Technology, 2000. Society of Polymer Science, Japan.

Y. Okahata, Sensing of Odorous and Bitter Substances by using a Bilayer Molecular Film-coated Quartz Oscillator, *Biophysics*. vol. 28. No. 6 Pandect. Tokyo Institute of Technology. 1988, Japan.

Y. Okahata, Prospect for Chemical Information Conversion Membrane, Molecular Recognition to be realized on a Lipid Bilayer Molecular Membrane, *SEN-I Gakkaishi* (*Fiber and Industry*) vol. 46, No. 2 Feature: Functional Macromolecular Membranes Films, 1990, Japan.

K. Ariga et al., Evaluation of the Viscoelasticity of the Membrane with the Use of a Quartz Oscillator, Phase Transition of the LB film . vol. 28 No. 11, Tokyo Institute of Technology, 1990, Japan.

H. Yokoi et al., *The 48th Symposium on Macromolecules*, The Two Dimensional Orientation Control of Amphiphilic α-helix Molecule, II P f094, Nagoya Institute of Technology, Oct. 6, 1999, Niigata, Japan.

H. Yokoi et al., *The 49th Annual Meeting of the Society of Polymer Science, Japan* (*SPSJ*). The pH Dependence of Molecular Orientation in Monolayer Composed of Amphiphilic α-helix Molecule at Air-water Interface. I p. 173, Nagoya Institute of Technology. May 29, 2000. Nagoya, Japan.

H. Yokoi et al., *The 49th Symposium on Macromolecules*, Preparation of LB Film consisting of Amphiphilic α-helix Molecule. IS 07, Nagoya Institute of Technology, Sep. 27, 2000, Sendai, Japan.

H. Yokoi et al., *The 49th Symposium on Macromolecules*, Evaluation of molecular orientation of amphiphilic α-helix water surface monomolecular film, IIPd090. Nagoya Institute of Technology, Sep. 27, 2000. Sendai, Japan.

Y. Nagata, et al., *The 43rd Annual Meeting of the Society of Polymer Science, Japan* (*SPSI*), Preparation and Function of Polypeptide Containing a Substrate-bin-ding Site at the Molecular Terminal, Nov. 9, 2006, Nagoya Institute of Technology, and National Institute of Materials and Chemical Research, Tsukuba, May 26, 1994, Nagoya, Japan.

H. Hosokawa et al., *The 44th Annual Meeting of the Society of Polymer Science, Japan* (*SPSJ*). Functional Control of Polypeptide Containing an Inclusion Terminal Group. II Pel 119, May 30, 1995, Yokohama, Japan.

H. Hosokawa et al., Functional Control of Polypeptide Containing an Inclusion Terminal Group, Preprints of Annual meeting of the Society of Fiber Science and Technology, Japan, G-264 3G17, Jun. 29, 1995, Tokyo (Sen-I Gakkai).

H. Hosokawa et al., *45th Annual Meeting of Society of Polymer Science of Japan*, Monolayers of polypeptide containing a cyclodextrin at the terminal. IIIPb100, Nagoya Institute Technology, Nagoya and National Institute of Materials and Chemical Research. Tsukuba, May 29, 1996, Nagoya, Japan.

H. Hosokawa et al., *45th Symposium of Society of Polymer Science of Japan*, Molecular orientation of polypeptide containing a cyclodextrin at the terminal in the monolayer and is function. 2Pb44, Nagoya Institute of Technology, Oct. 2, 1996. Hiroshima, Japan.

H. Hosokawa et al., *46th Annual Meeting of Society of Polymer Science of Japan*, Structural control of polypeptide containing an active site at the terminal in monolayer and its function, IIPb108, Nagoya Institute of Technology, May 24, 1997, Tokyo, Japan.

A. Kato et al., *47th Annual Meeting of Society of Polymer Science of Japan*, Characterization of polypeptide monolayer containing the molecular recognition site, IIIPd124, Nagoya Institute of Technology, May 29, 1998. Kyoto, Japan.

A. Kato et al., *29th Annual Meeting of Union of Chemistry-Related Societies in Chubu Area, Japan*. Characterization of polypeptide monolayer containing a cyclodextrin at the terminal. IB0705. Nagoya Institute of Technology, Oct. 3, 1998. Toyohashi, Japan.

H. Yokoi et al., The control of molecular orientation in monolayer of amphiphilic α-helix, *Preprints presented at*

*15th Symposium of Membrane Science and Technology*, 3PA53, Nagoya Institute of Technology and Core Research for Evolutional Science and Technology, May 12, 1999, Chiba, Japan (Sen-I Gakkai).
T. Doi et al., *48th Symposium of Society of Polymer Science of Japan*, The molecular orientation and oscillation of polypeptide monolayer at oil/water interface, IIIJ02. Nagoya Institute of Technology and Core Research for Evolutional Science and Technology, Oct. 8, 1999, Niigata, Japan.
T. Doi et al., *Open Symposium of Creation and Functions of New Molecules and Molecular Assemblies sponsored by Core Research for Evolutional Science and Technology* (*CREST*). Creation of peptide-type signal transmitting function and control of its function. A506. Nagoya Institute of Technology, Nov. 28, 2000, at Japan Science and Technology Corporation (JST), Tokyo, Japan.
T. Doi , Molecular alignment of poly(γ-methyl-L-glutamate) containing a β-cyclodextrin at the terminal and molecular identification (n-hexane/water interface), *Control of molecular alignment of polypeptide molecular film* published by Dr. Tomokiyo Doi. chapter 4, 2000.
Thomas M. Cooper, et. Al., "Formation of Polypeptide-Dye Multilayers by an Electrostatic Self-Assembly Technique," LANGMUIR 1995, vol. 11, No. 7, pp. 2173-2178.
Munekazu Date, et al., "52.3: Direct-viewing Display Using Alignment-controlled PDLC and Holographic PDLC," SID 00 Digest pp. 1184-1187.
Robert J. Collier, et al, "Optical Holography," Chapter 9, §§9.1 & 9.2, pp. 228-233. Academic Press, New York.
Baril et al, "Chromatography of ribonuclease treated myosin extracts from early embryonic chick muscle," Science (1964) 146:413-414.
Liu, et al., "Cell-ELISA using B-galactosidase conjugated antibodies" Journal of Immunological Methods 234 (Feb. 2000) p. 153-167).
S. Sugai et al., Poly(γ-alkyl Glutamates), Journal of Polymer Science: Part A-2, vol. 4, 183-198 (1966).
Crick, F.H.C., The Packin g of α-Helices: Simple Coiled-Coils, Acta Cryst (1953) 6, 689-697.
Minamoto, Y. et al., Polymethylglutamate as a New Matrix for Covalently Immobilized Enzymes: Preparation and Properties of Urease and Uricase, Biotech and Bioeng'n, vol. XXII, pp. 1225-1235 (1980).
Kinoshita, T., "Structural color forming system composed of polypeptide-based LB films," *Nanotechnology and Nano-Interface Controlled Electronic Devices*, Chapter 13, 2003, pp. 233-252.
Miyagi, T. "Structural Color with Polypeptide LB Film," *Transactions of the Materials Research Society of Japan*, 27 3, 555-558 (2002).
Yokoi, H., "Polypeptide membranes at an interface," Prog. Polym. Sci., pp. 341-357, 2003.
Doi, et al "The Control of Structure and Functions of LB-Film Composed of Bio-Related Polymers," 1st Int'l Symposium on Biomimetic Materials Processing, Jan. 11, 2001, in Nagoya, p. 19.
Kinoshita, T., "Control of Superfine Structure of Membrane and Their Characterization," *Polymer*, vol. 50, Dept. of Eng'g, Nagoya Institute of Technology, pp. 648-651, Sep. 2001.
Kawaguchi, T., "A Device For Visual Detection of Antigens and Antibodies By Means of Light Interference," *Thin Solid Films*, vol. 191, pp. 369-381, 1990.
Buchel, M. et al., "Langmui-Blodgett-Kuhn Multilayers of Polyglutamates with Azobenzene Moieties: Investigations of Photoinduced Changes in the Optical Properties and Structure of the Films," Langmuir 1995, vol. 11, p. 4460-4466.
Menzel, H. et al., "Small-Angle X-ray Scattering and Ultraviolet-Visible Spectroscopy Studies on the Structure and Structural Changes in Langmuir-Blodgett Films of Polyglutamates with Azobenzene Moieties Tethered by Alkyl Spacers of Different Lengths" Langmuir 1994, vol. 10, p. 1926-1933.
Okahata, Y. et al., "Orientation of DNA Double Strands in a Langmuir-Blodgett Film," Langmuir 1966, vol. 12, p. 1326-1330.
Parazak, D.P. et al., "Comparison of Host-Guest Langmuir-Blodgett Multilayer Formation by Two Different Amphiphilic Cyclodextrins," Langmuir 1996, vol. 12, p. 4046-4049.
Doi, et al. "The control of structure and functions of Lb-Film composed of bio-related polymers." First International Symposium on Biomimetric Materials Processing. Jan. 11, 2001, p. 19.
Kinoshita, et al. "Preparation of a structural color forming system by polypeptide-based Ib films." The fourth NIMC International Symposium on Photoreaction Control and Photofunctional Materials. Mar. 14, 2001, pp. 1-9-1-12.
Yokoi, et al. "Nano-Phase separation in the monolayer composed of αHelical Copolypeptide at Air/Water Interface." Chemistry Letters 2000. Jul. 13, 2000, pp. 1210-1211 (The chemical Society of Japan).
Mouri, et al. "The molecular recognition and polypeptide orientation in the monolayer at oil/water interface." 12th Academic Symposium of MRS Japan manuscripts. Dec. 7, 2000, p. 66.
Hosokawa, et al. The molecular orientation of a peptide-based amphiphile at Hexane/Water Interface—Chemistry Letters 1997. Apr. 19, 1997, pp. 745-746 (The Chemical Society of Japan).
Kinoshita, et al. "The guest-induced oscillation of a monolayer composed of polypeptide containing β-cyclodextrin at the terminal". Chaos vol. 9, No. 2, Jan. 19, 1999, pp. 276-282 (American Institute of Physics).

* cited by examiner

MOLECULAR ELECTRIC WIRE, MOLECULAR ELECTRIC WIRE CIRCUIT USING THE SAME AND PROCESS FOR PRODUCING THE MOLECULAR ELECTRIC WIRE CIRCUIT

BACKGROUND OF THE INVENTION

1. Field of the Invention

The present invention relates to a molecular electric wire comprising an ecological material and enabling a microscopic wiring, a molecular electric wire circuit using the molecular electric wire and an effective process for producing the molecular electric wire circuit.

2. Description of the Related Art

Recently, nanotechnology is attracting increasing attention as a key to solving problems in various fields including information technology, biotechnology, medical technology, energy technology, environmental technology and so forth. An electric circuit designed by taking advantage of nanotechnology will enable a paper thin display and so forth since such electric circuit does not require space unlike conventional electric circuits. Such display requires a molecular electric wire that enables a microscopic wiring; however, practical examples have not yet been provided of a molecular electric wire that is formed of an environmentally benign ecological material and enables microscopic wiring and of an electric circuit using the molecular electric wire.

SUMMARY OF THE INVENTION

In order to meet with the above demands and so forth in the art, an object of the present invention is to provide a molecular electric wire that is formed of an environmentally benign ecological material and enables a microscopic wiring, a molecular electric wire circuit using the molecular electric wire and an effective process for producing the molecular electric wire circuit.

DESCRIPTION OF THE PREFERRED EMBODIMENTS

{Molecular Electric Wire}

Figure 1:
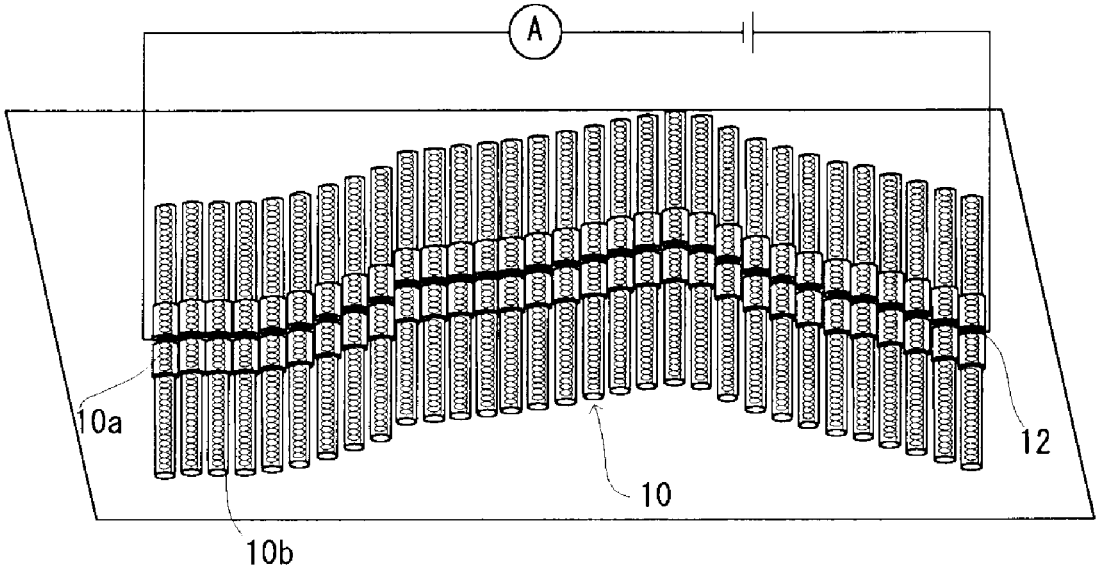
FIG. 1 is a schematic illustration of an example of a molecular electric wire circuit of the present invention.

The following first to fourth embodiments are preferable as embodiments of the molecular electric wire of the present invention.

The first embodiment of the present invention is a molecular electric wire comprising a rod-shaped organic molecule and an electroconductive material, the electroconductive material being carried by the rod-shaped organic molecules.

The second embodiment is a molecular electric wire comprising two rod-shaped organic molecule arrays each of which is formed of a plurality of amphiphilic rod-shaped organic molecules each having a hydrophilic end and a lipophilic end and being aligned in a substantially orthogonal direction with respect to a longitudinal direction thereof, the amphiphilic rod-shaped organic molecules being arranged so that the lipophilic ends of the rod-shaped organic molecules are directed towards an identical orientation, and the rod-shaped organic molecule arrays being arranged so that either the lipophilic ends of one of the arrays contact with the lipophilic ends of the other array or the hydrophilic ends of one of the arrays contact with the hydrophilic ends of another array with an electroconductive material being intervened between each pair of the contacting ends.

The third embodiment is a molecular electric wire obtainable by contacting an end of a rod-shaped organic molecule carrying an electroconductive material with an end of another rod-shaped organic molecule carrying an electro conductive material. In other words, the molecular electric wire is obtainable by contacting an end of a molecular electric wire with an end of another molecular electric wire according to the first embodiment. A branched wiring is realized by providing a branch at the contact portion.

The fourth embodiment is a molecular electric wire comprising a plurality of unit electroconductive molecules each having a rod-shaped organic molecule carrying an electroconductive material, a target of capture bonded to an end of the rod-shaped organic molecule and a capturing structural element bonded to another end of the rod-shaped organic molecule for specifically capturing the target of capture, the target of capture in one of the unit electroconductive molecules being captured by the capturing structural element of another one of the unit electroconductive molecules.

{Rod-shaped Organic Molecule}

Examples of the rod-shaped organic molecule may be a biopolymer, polysaccharides, etc.

Preferred examples of the biopolymer may be an electroconductive fibrous protein, α-helix polypeptide, a nucleic acid (DNA, RNA), etc. Examples of the electroconductive fibrous protein are those having an α-helix structure such as α-keratin, myosin, epidermin, fibrinogen, tropomyosin, silk fibroin, etc.

Preferred examples of the polysaccharides may be amylose, etc.

Among the rod-shaped organic molecules, a helical organic molecule having a helix structure is preferred since it can stably maintain linearity of the rod-shape, and also, other materials can be intercalated ("intercalate" means "carry internally", and the same applies to the following descriptions) inside thereof when so required. Preferred examples of the helical organic molecule among the above mentioned rod-shaped organic molecules may be the α-helix polypeptide, DNA, amylose, etc.

{α-Helix Polypeptides}

α-helix polypeptides are referred to as one of the secondary structures of polypeptides. The polypeptide rotates one time (forms one spiral) for each amino acid 3.6 residue, and a hydrogen bond, which is substantially parallel to the axis of the helix, is formed between a carbonyl group (—CO—) and an imide group (—NH—) of each fourth amino acid, and this structure is repeated in units of seven amino acids. In this way, the α-helix polypeptide has a structure which is stable energy-wise.

The direction of the spiral of the α-helix polypeptide is not particularly limited, and may be either wound right or wound left. Note that, in nature, only structures whose direction of spiral is wound right exist from the standpoint of stability.

The amino acids which form the α-helix polypeptide are not particularly limited provided that an α-helix structure can be formed, and can be appropriately selected in accordance with the object. However, amino acids which facilitate formation of the α-helix structure are preferable. Suitable examples of such amino acids are aspartic acid (Asp), glutamic acid (Glu), arginine (Arg), lysine (Lys), histidine (His), asparagine (Asn), glutamine (Gln), serine (Ser), threonine (Thr), alanine (Ala), valine (Val), leucine (Leu), isoleucine (Ile), cysteine (Cys), methionine (Met), tyrosine (Tyr), phenylalanine (Phe), tryptophan (Trp), and the like. A single one of these amino acids may be used alone, or two or more may be used in combination.

By appropriately selecting the amino acid, the property of the α-helix polypeptide can be changed to any of hydrophilic, hydrophobic, and amphiphilic. In the case in which the α-helix polypeptide is to be made to be hydrophilic, suitable examples of the amino acid are serine (Ser), threonine (Thr), aspartic acid (Asp), glutamic acid (Glu), arginine (Arg), lysine (Lys), asparagine (Asn), glutamine (Gln), and the like. In the case in which the α-helix polypeptide is to be made to be hydrophobic, suitable examples of the amino acid are phenylalanine (Phe), tryptophan (Trp), isoleucine (Ile), tyrosine (Tyr), methionine (Met), leucine (Leu), valine (Val), and the like.

In the α-helix polypeptide, the carboxyl group, which does not form a peptide bond and which is in the amino acid which forms the α-helix, can be made to be hydrophobic by esterification. On the other hand, an esterified carboxyl group can be made to be hydrophilic by hydrolysis.

The amino acid may be any of a L-amino acid, a D-amino acid, a derivative in which the side chain portion of a L-amino acid or a D-amino acid is modified, and the like.

The number of bonds (the degree of polymerization) in the α-helix polypeptide is not limited and can be suitably selected according to the object; however, the number of bonds may preferably be from 10 to 5,000.

If the number of bonds (the degree of polymerization) is less than 10, it may be impossible for the polyamino acid to form a stable α-helix in some cases, while it may be difficult in some cases to establish a vertical orientation if the number of bonds exceeds 5,000.

Suitable specific examples of the α-helix polypeptide are polyglutamic acid derivatives such as poly(γ-methyl L-glutamate), poly(γ-ethyl L-glutamate), poly(γ-benzyl L-glutamate), poly(n-hexyl L-glutamate), and the like; polyaspartic acid derivatives such as poly(β-benzyl L-aspartate) and the like; polypeptides such as poly(L-leucine), poly(L-alanine), poly(L-methionine), poly(L-phenylalanine), poly(L-lysine)-poly(γ-methyl L-glutamate), and the like.

The α-helix polypeptide may be a commercially available α-helix polypeptide, or may be appropriately synthesized or prepared in accordance with methods disclosed in known publications and the like.

As one example of synthesizing the α-helix polypeptide, the synthesis of block copolypeptide [poly(L-lysine)$_{25}$-poly(γ-methyl L-glutamate)$_{60}$]PLLZ$_{25}$-PMLG$_{60}$ is as follows. As is shown by the following formula, block copolypeptide [poly(L-lysine)$_{25}$-poly(γ-methyl L-glutamate)$_{60}$]PLLZ$_{25}$-PMLG$_{60}$ can be synthesized by polymerizing N$^{\varepsilon}$-carbobenzoxy L-lysine N$^{\alpha}$-carboxy acid anhydride (LLZ-NCA) by using n-hexylamine as an initiator, and then polymerizing γ-methyl L-glutamate N-carboxy acid anhydride (MLG-NCA).

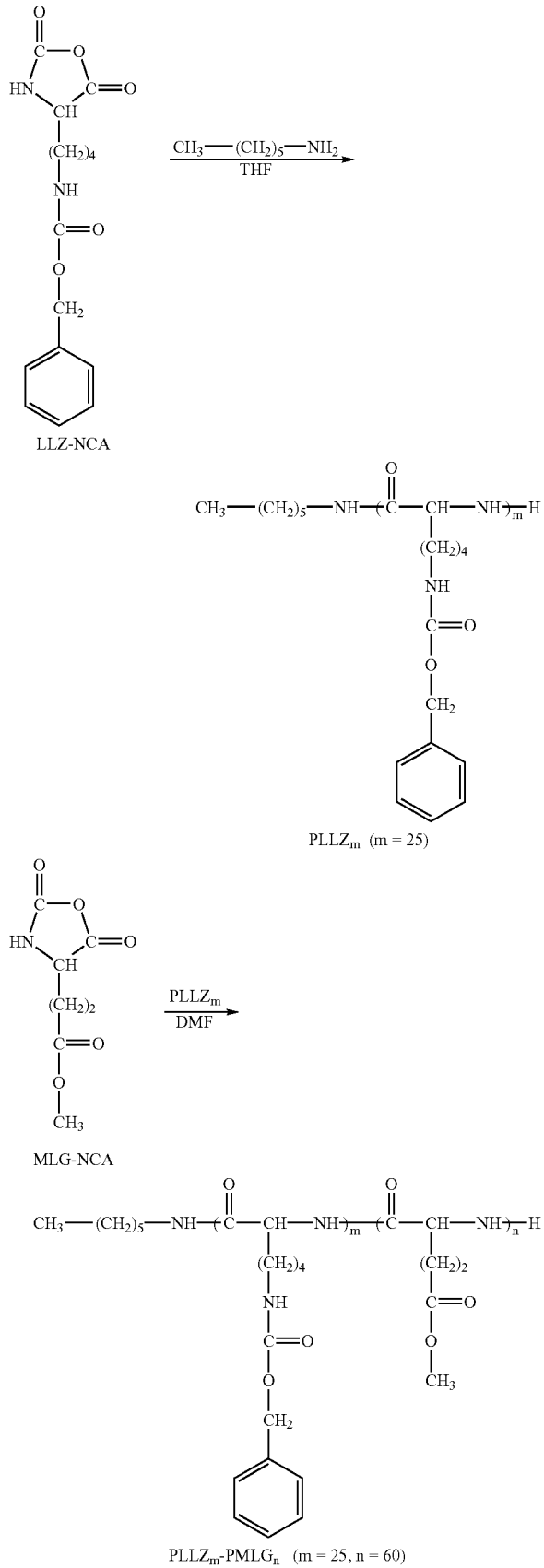

Synthesis of the α-helix polypeptide is not limited to the above-described method, and the α-helix polypeptide can be synthesized by a genetic engineering method. Specifically, the α-helix polypeptide can be manufactured by transforming a host cell by an expression vector in which is integrated a DNA which encodes the target polypeptide, and culturing the transformant, and the like.

Examples of the expression vector include a plasmid vector, a phage vector, a plasmid and phage chimeric vector, and the like.

Examples of the host cell include prokaryotic microorganisms such as *E. coli, Bacillus subtilis,* and the like; eukaryotic microorganisms such as yeast and the like; zooblasts, and the like.

The α-helix polypeptide may be prepared by removing the α-helix structural portion from a natural fibrous protein such as α-keratin, myosin, epidermin, fibrinogen, tropomyosin, silk fibroin, and the like.

DNA

The DNA may be a single-stranded DNA. However, the DNA is preferably a double-stranded DNA from the standpoints that the rod-shape can be stably maintained, other substances can be intercalated into the interior, and the like.

A double-stranded DNA has a double helix structure in which two polynucleotide chains, which are in the form of right-wound spirals, are formed so as to be positioned around a single central axis in a state in which they extend in respectively opposite directions.

The polynucleotide chains are formed by four types of nucleic acid bases which are adenine (A), thiamine (T), guanine (G), and cytosine (C). The nucleic acid bases in the polynucleotide chain exist in the form of projecting inwardly within a plane which is orthogonal to the central axis, and form so-called Watson-Crick base pairs. Thiamine specifically hydrogen bonds with adenine, and cytosine specifically hydrogen bonds with guanine. As a result, in a double-stranded DNA, the two polypeptide chains are bonded complementarily.

The DNA can be prepared by known method such as PCR (Polymerase Chain Reaction), LCR (Ligase Chain Reaction), 3SR (Self-Sustained Sequence Replication), SDA (Strand Displacement Amplification), and the like. Among these, the PCR method is preferable.

Further, the DNA can be prepared by being directly removed enzymatically from a natural gene by a restriction enzyme. Or, the DNA can be prepared by a genetic cloning method, or by a chemical synthesis method.

In the case of a genetic cloning method, a large amount of the DNA can be prepared by, for example, integrating a structure, in which a normal nucleic acid has been amplified, into a vector which is selected from plasmid vectors, phage vectors, plasmid and phage chimeric vectors, and the like, and then introducing the vector into an arbitrary host in which propagation is possible and which is selected from prokaryotic microorganisms such as *E. coli, Bacillus subtilis,* and the like; eukaryotic microorganisms such as yeast and the like; zooblasts, and the like.

Examples of chemical synthesis methods include liquid phase methods or solid phase synthesis methods using an insoluble carrier, such as a tolyester method, a phosphorous acid method, and the like. In the case of a chemical synthesis method, the double-stranded DNA can be prepared by using a known automatic synthesizing device and the like to prepare a large amount of single-stranded DNA, and thereafter, carrying out annealing.

Amylose

Amylose is a polysaccharide having a spiral structure in which D-glucose, which forms starch which is a homopolysaccharide of higher plants for storage, is joined in a straight chain by α-1,4 bonds.

The molecular weight of the amylose is preferably around several thousand to 150,000 in number average molecular weight.

The amylose may be a commercially available amylose, or may be appropriately prepared in accordance with known methods.

Amylopectin may be contained in a portion of the amylose.

The length of the rod-shaped body is not particularly limited, and may be appropriately selected in accordance with the object.

The diameter of the rod-shaped body is not particularly limited, and is about 0.8 to 2.0 nm in the case of the α-helix polypeptide.

The entire rod-shaped body may be hydrophobic or hydrophilic. Or, the rod-shaped body may be amphiphilic such that a portion thereof is hydrophobic or hydrophilic, and the other portion thereof exhibits the opposite property of the one portion.

If the rod-shaped body is amphiphilic, an emulsion could be obtained when the rod-shaped bodies are being dispersed in an oil phase or in an aqueous phase, thus it is preferable from the viewpoint of simple membrane generation.

FIG. 1 shows an example of the amphiphilic rod-shaped organic molecule. In FIG. 1, the rod-shaped organic molecule 10 has a hydrophobic portion 10*a* at an end and a hydrophilic portion 10*b* at another end.

{Electroconductive Material}

The rod-shaped organic molecule carries the electroconductive material. Therefore, the rod-shaped organic molecule has good electroconductivity, and it is possible to establish electrical continuity among a plurality of rod-shaped organic molecules.

The electroconductive material is not limited, and can be suitably selected according to the object. Examples of the electroconductive material include a metallic atom, a metal hydroxide, a metal oxide, a metal sulfide, a carbon compound, an ionized compound, a halogen atom, etc. These may be used alone or in combinations thereof.

Examples of the metal atom include, but are not limited to, platinum, gold, silver, copper, chrome, iron, nickel, cobalt, zinc, magnesium, aluminum, stannum, indium, etc.

Examples of the metal oxide include, but are not limited to, oxides of the above metal atoms, etc.; preferred examples thereof include zinc oxide, titanium oxide, red iron oxide, chromium oxide, black iron oxide, a composite oxide, titanium yellow, cobalt blue, cerulean blue, cobalt green, indium stannum oxide (ITO), etc.

Examples of the metal hydroxide include, but are not limited to, hydroxides of the above metal atoms, alumina white, yellow iron oxide, pyridine (or pyrimidine), etc.

Examples of the metal sulfide include, but are not limited to, sulfides of the above metal atoms, cadmium yellow, cadmium red, vermilion, lithopone, etc.

Examples of the carbon compound include, but are not limited to, carbon black, carbon nano-tube, carbon nano-claster, fullerene, etc.

Examples of the ionized compound include, but are not limited to, chromium acid, sulphate, carbonate, silicate, phosphate, arsenate, a ferrocyanic compound, dyes, etc., preferably, and barium sulphate, calcium carbonate, ultramarine, Angan violet, cobalt violet, emerald green, iron blue, etc. Among the above ionized compound, the cationic dyes, phthalocyanine dyes, azoic dyes, acridine orange, ethidium bromide include preferred, and examples of the cationic dyes include basic dyes, triphenylmethane dyes, cyanic dyes, heterocyclic dyes, etc. Among the above, the acridine orange is advantageous from the viewpoint that, when it is intercalated in the rod-shaped organic molecule, photocurrent is allowed to run along the rod-shaped organic molecule in response to on and off of an irradiation with visible rays.

Examples of the halogen atoms include, but are not limited to, fluorine, chlorine, iodine, bromine, etc.

Preferred examples of the electroconductive material also include a dopant that is typically used for doping an aromatic π conjugated copolymer. By doping such a dopant, a positive charge is delocalized at the π conjugated system, for example; therefore, electric charges transfer in response to an application of a voltage to cause electroconductivity.

Examples of the dopant include an acceptor (electron acceptor) dopant, a donor (electron donor) dopant, etc.

Preferred examples of the acceptor (electron acceptor) dopant include halogen (chlorine, bromine, iodine, fluorine iodide, chlorine iodide, bromine iodide, etc.), Lewis acid ($PF_6$, $AsF_5$, $SbF_6$, $BF_3$, $BCl_3$, $BBr_3$, etc), protic acid (HF, HCl, $HNO_3$, $H_2SO_4$, $HClO_4$), a transition metal compound ($FeCl_3$, $TiCl_3$, $ZrCl_4$, $NbCl_5MoCl_6$, $WCl_6$, etc.), etc.

Preferred examples of the donor (electron donor) dopant include an alkali metal (Li, Na, K, Rb, Cs, etc.), an alkali-earth metal (Ca, Sr, Ba, etc.), lanthanoid (Eu, etc.), etc.

It is possible to cause the rod-shaped organic molecule to carry the electroconductive material by conventional methods without any particular limitations thereto, and, for example, by soaking the rod-shaped organic molecule in a solution containing the electroconductive material.

The amount of electroconductive material to be carried by the rod-shaped organic molecule may be properly selected depending on the application, etc.

A preferred mode of "carriage" may be such that the electroconductive material is carried by the rod-shaped organic molecule on at least one of an inner portion thereof, an end portion thereof and a peripheral portion thereof and, also, it is preferable to intervene the electroconductive material at the contacting portion of the molecular electric wire to another molecular electric wire. The intervention of the electroconductive material is advantageous since it is possible to achieve an excellent electrical continuity between the molecular electric wires without generating too large an electrical resistance at a boundary existing between the molecular electric wires because of the electroconductive material.

The electroconductive material may be intervened between the molecular electric wires in accordance with, but not limited to, conventional methods.

{Capturing Structural Element and Target of Capture}

The capturing structural element is not particularly limited provided that it can capture the target of capture and may be suitably selected according to the object.

Examples of capturing mode include, but are not limited to, physical adsorption, chemical adsorption, and the like. These modes allow formation of bonds by, for example, hydrogen bonds, intermolecular forces (van der Wals forces), coordinate bonds, ionic bonds, covalent bonds, and the like.

Particular examples of the capturing structured element preferably include, host components involved in clathrate compound (hereinafter, interchangeably referred to as "host"), antibody, nucleic acid, hormone receptor, lectin, and physiologically active agent receptor. Among all, nucleic acid is preferred in view of easy formation of any alignment and more preferably, single-stranded DNA or single-stranded RNA.

When the capturing structural element is the clathrate compound; the antibody; the nucleic acid; the hormone receptor; the lectin or the bioactive substance receptor, the target of capture may be a guest (component to be captured); an antigen; a nucleic acid, tubrine, chitin, etc.; a hormone; sugar, etc.; or an bioactive substance, respectively.

In the case where the capturing structural element is a single stranded DNA or RNA and the target of capture is a single stranded DNA or RNA which is complementary to the capturing structural element, the capturing structural element and the target of capture can easily be bound to each other; the above combination is preferred from the viewpoint that it is possible to intercalate the electroconductive material between the nucleic acids.

The clathrate compound is not limited so far as it is capable of recognizing molecule recognition (host-guest binding capability), and can be suitably selected according to the object. Preferred examples of the clathrate compound may be one having a tubular (one-dimensional) void cavity, one having a layered (two-dimensional) void cavity, one having a cage-like (three-dimensional) void cavity, etc.

Examples of the clathrate compound having the tubular (one dimensional) void cavity are urea, thiourea, deoxycholic acid, dinitrodiphenyl, dioxytriphenylmethane, triphenylmethane, methylnaphthalene, spirochroman, PHTP (perhydrotriphenylene), cellulose, amylose, cyclodextrin (provided that the void cavity has a cage-like shape in the solution), etc.

Examples of the target of capture that the urea can capture may be an n-paraffin derivative, etc.

Examples of the target of capture that the thiourea can capture may be a branched or cyclic hydrogen carbonate, etc.

Examples of the target of capture that the deoxycholic acid can capture may be paraffin, aliphatic acid, an aromatic compound, etc.

Examples of the target of capture that the dinitrodiphenyl can capture may be a diphenyl derivative, etc.

Examples of the target of capture that the dioxytriphenylmethane can capture may be paraffin, n-alkene, squalene, etc.

Examples of the target of capture that the triphenylmethane can capture may be paraffin, etc.

Examples of the target of capture that the methylnaphthalene can capture may be $C_{1-16}$ n-paraffins, branched paraffin, etc.

Examples of the target of capture that the spirochroman can capture may be paraffin, etc.

Examples of the target of capture that the PHTP (perhydrotriphenylene) can capture may be chloroform, benzene, various copolymer materials, etc.

Examples of the target of capture that the cellulose can capture may be $H_2O$, paraffin, $CCl_4$, a pigment, iodine, etc.

Examples of the target of capture that the amylose can capture may be aliphatic acid, iodine, etc.

The cyclodextrin is a cyclic dextrin that is generated by a decomposition of starch induced by amylase, and α-cyclodextrin, β-cyclodextrin and γ-cyclodextrin are known as such cyclodextrin. In the present invention, cyclodextrin derivatives obtained by substituting a part of a hydroxy group of each of the above cyclodextrins with another functional group such as an alkyl group, an aryl group, an alkoxy group, an amide group, a sulfonic acid group, etc., may be used as the cyclodextrin.

Examples of the target of capture that the cyclodextrin can capture may be a phenol derivative such as thymol, eugenol, resorcin, ethyleneglycolnonophenylether, 2-hydroxy-4-methoxy-benzophenone, etc., a steroid such as a benzoic acid derivative such as salicylic acid, methylparaben, ethylparaben, etc., and ester, cholesterol thereof, etc., a vitamin such as ascorbic acid, retinol, tocopherol, etc., hydrocarbon such as limonene, aryl isothiocyanate, sorbic acid, an iodine molecule, methyl orange, Congo red, 2-p-toluidinylnaphthalene-6-sulfonic acid potassium salt (TNS), etc.

Examples of the layered (two-dimensional) clathrate compound may be a clay mineral, graphite, smectite, montmorillonite, a zeolite, etc.

Examples of the target of capture that the clay mineral can capture may be a hydrophilic substance, a polar compound, etc.

Examples of the target of capture that the graphite can capture may be O, $HSO_4$—, halogen, halogenated compound, an alkali metal, etc.

Examples of the target of capture that the montmorillonite can capture may be brucine, codeine, o-phenylenediamine, benzidine, peperidine, adenine, guanidine (or guanine), and lipoid (or lipoamide) thereof, etc.

Examples of the target of capture that the zeolite can capture may be $H_2O$, etc.

Examples of the cage-like (three dimensional) clathrate compound may be hydroquinone, a gaseous hydrate, o-trithymotide, oxyflavan, dicyanoamminenickel, a cryptand calixarene, a crown compound, etc.

Examples of the target of capture that the hydroquinone can capture may be HCl, $SO_2$, acetylene, a noble gas element, etc.

Examples of the target of capture that the gaseous hydrate can capture may be halogen, a noble gas element, lower hydrocarbon, etc.

Examples of the target of capture that the o-trithymotide can capture may be cyclohexane, benzene, chloroform, etc.

Examples of the target of capture that the oxyflavan can capture may be an organic base, etc.

Examples of the target of capture that the dicyanoamminenickel can capture may be benzene, phenol, etc.

Examples of the target of capture that the cryptand can capture may be $NH^{4+}$, various metal ions, etc.

The calixarene is a cyclic oligomer obtainable by bonding phenol units through a methylene group, each of the phenol units being synthesized from phenol and formaldehyde under appropriate conditions, and 4 to 8 nuclides of such calixarene are known. Among such calixarenes, examples of the target of capture that the p-t-butyl calixarene (n=4) can capture may be chloroform, benzene, toluene, etc. Examples of the target of capture that the p-t-butyl calixarene (n=5) can capture may be isopropyl alcohol, acetone, etc. Examples of the target of capture that the p-t-butyl calixarene (n=6) can capture may be chloroform, methanol, etc. Examples of the target of capture that the p-t-butyl calixarene (n=7) can capture may be chloroform, etc.

The crown compound includes not only a crown ether having oxygen as an electron donating donor atom, but also a macro cyclic compound having a donor atom such as nitrogen and sulfur, which are analogs thereof, as cyclic structure-forming atoms and a multicyclic crown compound having two or more rings whose representative compound is cryptand. Examples of such a crown compound may be cyclohexyl-12-crown-4, dibenso-14-crown-4, t-butylbenso-15-crown-5, dibenzo-18-crown-6, dicyclohexyl-18-crown-6, 18-crown-6, tribenzo-18-crown-6, tetrabenzo-24-crown-8, dibenzo-26-crown-6, etc.

Examples of the target of capture that the crown compound can capture may be an alkali metal such as Li, Na, K, etc., various metal ions including an alkali earth metal such as Mg, Ca, etc., $NH^{4+}$, an alkylammonium ion, a guanidium ion, an aromatic diazonium ion, etc., and the crown compound forms complexes with these capture targets. In addition, a polar organic compound having a C—H unit (acetonitrile, malonnitrile, adiponitrile, etc.), a N—H unit (aniline, amino benzoic acid, amide, a sulphanate derivative, etc.) or an O—H unit (phenol, an acetic acid derivative) that is relatively high in acidity may also be used as the target of capture that the crown compound can capture, and the crown compound forms complexes with these capture targets.

The diameter of the void cavity of the clathrate compound is not limited, and may be suitably selected according to the object; however, the diameter may preferably be from 0.1 nm to 2.0 nm from the viewpoint of exerting stable molecular recognition capability (host-guest binding capability).

The method for bonding the capturing structural element and the target of capture to the rod-shaped organic molecule is not limited, and the method can be selected depending on the types and so forth of the capturing structural element, the target of capture and the rod-shaped organic molecule.

Hereinafter, another example of the molecular electric wire will be described with reference to FIG. 1. The molecular electric wire shown in FIG. 1 comprises two rod-shaped organic molecule arrays each of which is formed of a plurality of amphiphilic rod-shaped organic molecules 10 each having a hydrophilic end and a lipophilic end and being aligned in a substantially orthogonal direction with respect to a longitudinal direction thereof, the amphiphilic rod-shaped organic molecules being arranged so that the lipophilic (hydrophobic) ends 10*a* of the rod-shaped organic molecules are directed towards an identical orientation, and the rod-shaped organic molecule arrays being arranged so that the lipophilic ends 10*a* of one of the arrays contact with the lipophilic ends 10*a* of the other array (the hydrophilic ends 10*b* of one of the arrays may contact with the hydrophilic ends 10*b* of the other array) with the electroconductive material 12 being intervened between each pair of the contacting ends. An electrode is connected (contacted) at each of the ends of the molecular electric wire, and the electrodes are connected to an electric power source in order to energize the molecular electric wire. Here, if the electric power source is switched on, a line of the electroconductive materials 12 intervened between the amphiphilic rod-shaped organic molecules 10 functions as an electric wire, through which an electric current flows.

Figure 2:
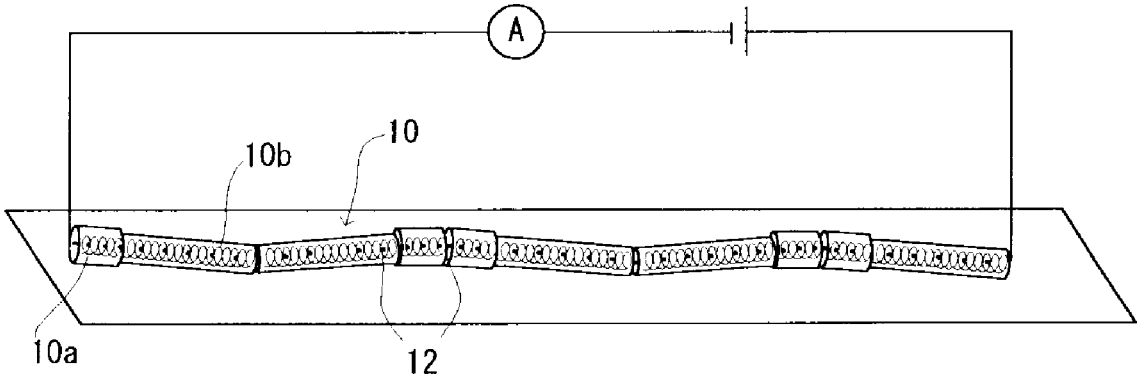
FIG. 2 is a schematic illustration of another example of the molecular electric wire circuit of the present invention.

Another example of the molecular electric wire will be described with reference to FIG. 2. The molecular electric wire shown in FIG. 2 is obtainable by contacting an end of a lipophilic (hydrophobic) portion 10*a* of one of amphiphilic rod-shaped organic molecules 10, each having a hydrophobic end and a lipophilic end, with an end of a lipophilic (hydrophobic) portion 10*a* of another one of the amphiphilic rod-shaped organic molecules 10, while contacting an end of a hydrophilic portion 10*b* of the one of the amphiphilic rod-shaped organic molecules 10 with an end of a hydrophilic portion 10*b* of still another one of the amphiphilic rod-shaped organic molecules 10, the molecular electric wire being extendable as required. An electrode is connected (contacted) to each of the ends of the molecular electric wire, and the electrodes are connected to an electric power source in order to energize the molecular electric wire. Here, if the electric power source is switched on, an electric current flows through the electric wire.

Figure 3:
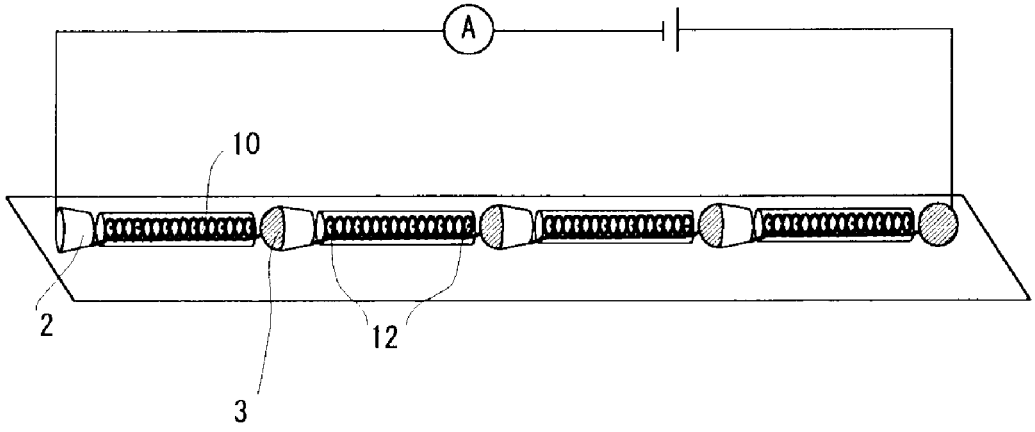
FIG. 3 is a schematic illustration of another example of the molecular electric wire circuit of the present invention.

Another example of the molecular electric wire will be described with reference to FIG. 3. The molecular electric wire shown in FIG. 3 is obtainable by connecting rod-shaped organic molecules 10, in each of which the capturing structural element 2 is bound to one end and a target of capture 3 that is captured specifically by the capturing structural element 2 is bound to the other end, in such a manner that a capturing structural element 2 in one of the rod-shaped organic molecules 10 captures a target of capture 3 in another one of the rod-shaped organic molecules 10, while a target of capture 3 of the one of the rod-shaped organic molecules 10 is captured by a capturing structural element 2 of still another one of the rod-shaped organic molecules 10, the molecular electric wire being extendable by the connection. An electrode is connected (contacted) to each of the ends of the molecular electric wire, and the electrodes are connected to an electric power source in order to energize the molecular electric wire. Here, if the electric power source is switched on, an electric current flows through the molecular electric wire.

Since the molecular electric wire of the present invention is formed of an environmentally benign ecological material and enables a microscopic wiring, the molecular electric wire can suitably be used in various fields including information technology, biotechnology, medical technology, energy technology and so on, and, especially, for the following molecular electric wire circuits of the present invention.

{Molecular Electric Wire Circuit}

The molecular electric wire circuit of the present invention uses the molecular electric wire of the present invention.

The molecular electric wire circuit comprises at least the molecular electric wire, in which the molecular electric wire is preferably fixed on a substrate or the like. The molecular electric wire circuit may further comprise electrodes and an electric power source for energizing the molecular electric wire and other apparatuses such as a capacitor that are selected properly to suit the purpose. Examples of other apparatuses are not limited, and can be suitably selected according to the object.

Since the molecular electric wire circuit of the present invention uses the molecular electric wire of the present invention that is formed of the environmentally benign ecological material and enables the microscopic wiring, the molecular electric wire circuit can suitably be used in various fields including information technology, biotechnology, medical technology, energy technology and so on. The process for producing the molecular electric wire circuit of the present invention is not limited, but the molecular electric wire circuit of the present invention can suitably be produced by the following processes.

{Process for Producing Molecular Electric Wire Circuit}

The following first to sixth embodiments are preferable as the process for producing the molecular electric wire circuit of the present invention.

In the first embodiment, a pattern is first formed on a substrate by way of the lithographic method. Next, rod-shaped organic molecules each having a bonding site that can be bonded to the pattern and carrying an electroconductive material are chemically and/or physically bonded to the pattern at the bonding sites. Thus, a circuit comprising the electroconductive molecules is formed.

In the second embodiment, a pattern is first formed on a substrate by way of an irradiation beam. Next, rod-shaped organic molecules each having a bonding site that can be bonded to the pattern and carrying an electroconductive material are bonded to the pattern at the bonding sites. Thus, a circuit comprising the electroconductive molecules is formed.

In the third embodiment, a layer of rod-shaped organic molecules each carrying an electroconductive material is first formed on a substrate. Next, portions other than a portion of the layer on which a pattern is to be formed are removed by etching. Thus, a circuit comprising the electroconductive molecules is formed.

In the fourth embodiment, a pattern is first formed on a substrate by disposing targets of capture that can be captured by capturing structural elements. Next, the targets of capture that can be captured by a capturing structural element, and then causing the target of capture to capture a capturing structural element in a rod-shaped organic molecule. The rod-shaped organic molecule has the capturing structural element which can capture the target of capture and carries an electroconductive material. Thus, a circuit comprising the electroconductive molecules is formed.

In the fifth embodiment, an electrostatic latent image of a pattern is first formed on a photosensitive substrate. Next, rod-shaped organic molecules each having a bonding site that can be bonded to the pattern and carrying an electroconductive material are bonded to the pattern at the bonding sites. Thus, the electrostatic latent image is developed to form a circuit comprising the electroconductive molecules.

In the sixth embodiment, either one of a hydrophilic pattern or a hydrophobic pattern is first formed on a substrate. Next, amphiphilic rod-shaped organic molecules each carrying an electroconductive material are bonded to the pattern. As a result, a circuit comprising the electroconductive molecules is formed.

{First Embodiment}

In the first embodiment, a pattern is first formed on a substrate.

Substrate

The substrate may be properly selected from conventional substrates for electric and electronic circuitries, and size, structure, etc., thereof are not limited. The shape of the substrate is not limited, too, but typically a plate-like substrate is used. Material of the substrate is also not limited, and may be an electroconductive material or an insulating material.

The electroconductive material is not limited, and can be suitably selected according to the object. Examples of the electroconductive material may be a metal, an alloy, a metal oxide, an electroconductive ceramic, an electroconductive polymer, etc. The above electroconductive materials may be used alone or in combination thereof.

Examples of the metal may be, but not limited to, platinum, gold, silver, copper, chrome, iron, nickel, cobalt, zinc, magnesium, aluminum, stannum, indium, etc.

Examples of the alloy may be alloys of the above-mentioned metals, etc.

Examples of the metal oxide may be indium tin oxide (ITO), etc.

Examples of the electroconductive ceramic may be aluminum nitride, carboloy, tungsten carbide, etc.

Examples of the electroconductive polymer are polyacetylene, polyaniline, polypyrrole, etc.

The insulating material is not limited, and can be suitably selected according to the object. Examples of the insulating material may be a fiber reinforced plastic (FRP), a ceramic, etc. These may be used alone or in combination thereof.

Examples of the resin may be a thermoplastic resin, a curable resin, a polymer alloy, a polymer blend, etc. Preferred examples of the thermoplastic resin may be generic resins such as polyethylene, polypropylene, polystyrene, polyvinyl chloride, an ABS resin, an AS resin, PVA resin, PET resin, polyvinylidene chloride, an engineering plastic such as polyamide, polyacetal, polycarbonate, polysulfone, polybutyleneterephthalate, a super engineering plastic such as polyethersulfone, polyphenylenesulfide, polyamideimide, polyetheretherketone, polyetherimide, polyimide, etc. Examples of the curable resin may be a thermosetting resin such as unsaturated polyester, an epoxy resin, a phenol resin, a urea resin, a melamine resin, a silicone resin, a polyurethane resin, a photo-curing resin, etc.

Preferred examples of the fiber reinforced plastic (FRP) may be those prepared by reinforcing a fiber such as a glass fiber, a carbon fiber, an aramid fiber, with the above-mentioned resins, etc.

Preferred examples of the ceramic may be a glass, zirconium oxide, silicon, etc.

An electroconductive substrate may be formed by coating a surface of the substrate of the insulating material with the electroconductive material. In this case, the electroconductive material may be applied on the surface of the substrate of the insulating material by way of lamination, sputtering, vapor deposition, electro less plating, etc.

The pattern is formed by way of lithography using a resist, typically by forming a film (layer) on the substrate by coating the resist or the like, and then irradiating electron beams on the film, exposing the film to light and so forth.

The type of the resist is not limited, and can be selected from conventional resists depending on the material of the substrate. Examples of the resist may be a photoresist, a thermally stable photoresist, a dry film photoresist, an electro-deposited photoresist, a dielectric methanofullerene, chrome, ITO, an electroconductive polymer, etc. These resists may be used alone or in combination thereof.

Examples of the photoresist may be a positive type photoresist, a negative type photoresist, etc.

Examples of the positive type photoresist may be those obtained by mixing a photo-sensitive agent prepared by esterifying o-naphthoquinonediazidesulfonate into a novolak resin, 2,3,4-trihydroxybenzophenone, tetrahydroxybenzophenone or the like with a cresol novolak resin.

Examples of the negative type photoresist may be a water soluble photoresist prepared by adding bichromate to a water soluble polymer such as casein, glue, polyvinyl alcohol, a cinnamic acid based resist prepared by reacting PVA with cinnamic acid chloride, a rubber based resist prepared by adding a bisazide compound as a photosensitive agent to a natural rubber, cyclized polyisoprene, polybutadiene, a photopolymerizable resist, etc.

Examples of the thermally stable photoresist may be a positive type thermally stable photoresist, a negative type thermally stable photoresist, etc.

Examples of the positive type thermally stable photoresist may be those prepared by introducing an o-nitrobenzyl group or an o-naphthoquinonediazide group as a photoreactive group to a polyimide precursor, etc.

Examples of the negative type thermally stable photoresist may be those having a structure that have a methacryloyl group as a photosensitive group and is ester-bonded to a carboxyl group of polymethacrylic acid, those prepared by introducing an amine compound having a photosensitive group to a polymethacrylic acid by ionic conjugation, a photosensitive polyoxazole precursor obtainable by a polycondensation of fluorinated diamine having a hydroxyl group and p-phenylene diacrylic acid, etc.

Examples of the dry film photoresist may be a conventional photopolymerizable type photopolymer, a copolymer of various (meth)acrylates, styrenes, acrylonitriles, etc., and (meth)acrylic acid, etc., wherein a main component is methylmethacrylate as a binder polymer.

Examples of the electro-deposited photoresist may be positive type electro-deposited photoresist, negative type electro-deposited photoresist, etc.

Examples of the negative type electro-deposited photoresist may be the photoresist containing a binder polymer, a photopolymerizable multifunctional acrylate monomer, a photopolymerization initiator, a thermopolymerization inhibitor, etc.

Examples of the photofabrication resist may be a positive type photoresist, a negative type photoresist, etc.

Examples of the positive type photofabrication photoresist may be those obtained by mixing an o-naphthoquinonediazide based compound with a cresol novolak resin, etc.

Examples of the negative type photofabrication photoresist may be a water soluble photoresist prepared by adding dichromate to a water soluble polymer such as casein, glue, polyvinyl alcohol, etc., a cinnamic acid based resist prepared by reacting PVA with cinnamic acid chloride, a rubber based resist prepared by adding a bisazide compound as a photosensitive agent to a natural rubber, cyclized polyisoprene, polybutadiene, etc., a photopolymerizable resist, etc.

The dielectric methanofullerene, chrome, ITO and electroconductive polymer may preferably be used when the substrate has insulating properties.

The dielectric methanofullerene is obtained by chemically modifying fullerene ($C_{60}$), and examples of which may be methanofullerene (a) represented by $C_{89}H_{30}O_4$, methanofullerene (b) represented by $C_{81}H_{34}O_{10}$, etc.

The dielectric methanofullerene has such characteristics as a small molecular size, a high resolution of 10 nano-order, usable for spin coating, a high sensitivity of 1 $mC/cm^2$ that is higher than fullerene by one digit or more, an excellent dry etching resistance and so forth and functions as a negative type resist wherein a non-irradiated portion of electron beams remains unchanged since a deformed spherical structure of $C_{60}$ resulting from chemical modification of fullerene is destroyed easily by light irradiation of electron beams.

Examples of the electroconductive polymer may be polyacetylene, polypyrrole, polyaniline, etc.

In the present invention, the resist to be used may preferably be an electrical insulating resist when the substrate has electroconductive properties or may preferably be an electroconductive resist when the substrate has electrical insulating properties.

Methods of and conditions for the lithography are not limited, and can be properly selected depending on the type of the resist to be used. For example, the lithography may preferably be performed by way of at least either one of the electron beam irradiation or exposure to light.

The electron beam irradiation may be performed by using a conventional electron beam lithography device and so on. The electron beam irradiation may preferably be employed as the lithography method when the resist is the dielectric methanofullerene, chrome, ITO or electroconductive polymer.

The exposure to light may be performed by using a conventional exposure device and so on, and the light to be employed may be, for example, infrared rays, visible rays, ultraviolet rays, X-rays, laser beams, etc.

In the lithography, it is preferred to perform at least either one of the electron beam irradiation or the exposure to light with respect to portions other than a portion on which a pattern is to be formed in a resist when the resist is the negative type resist, while it is preferred to perform at least either one of the electron beam irradiation or the exposure to light with respect to the portion on which a pattern is to be formed in a resist when the resist is the positive type resist.

The pattern is formed by way of lithography.

The pattern is made of one of the substrate and the resist, and the pattern may preferably be formed of gold, silver, platinum, silicon, titanium oxide, etc., in view of the facility for bonding of the pattern with the bonding sites of the rod-shaped organic molecules.

In the first embodiment, the rod-shaped organic molecules are bonded to the pattern and subsequently to the formation of the pattern.

The bonding is performed by a method that is suitably selected according to an object. For example, the rod-shaped organic molecules may be applied on the substrate on which the pattern is formed so that the bonding site of the rod-shaped organic molecules interact with the material forming the pattern, thereby achieving the bonding easily as a self-organization due to the interaction.

The rod-shaped organic molecule and the electroconductive material to be used in the first embodiment are as described in the "Molecular Electric Wire" of the present specification.

In the first embodiment, the circuit is formed by the electroconductive materials in the rod-shaped organic molecules aligned by being bonded to the pattern.

Here, a plurality of rod-shaped organic molecules may be aligned in parallel as being opposed to each other via the pattern as shown in FIG. 1 (here, the electroconductive materials may be present on the pattern or may be present in the rod-shaped organic molecules aligned in parallel while being adjacent to one another) or may be aligned in series along the pattern as shown in FIG. 2 (here, the electroconductive materials may be present in the rod-shaped organic molecules aligned in series while being adjacent to one another).

{Second Embodiment}

In the second embodiment, a pattern is formed on the substrate which was described in the first embodiment.

Among the substrates described above, the one having insulating properties may preferably be used, and a volume resistivity of the substrate may preferably be about $1\times10^{0}\Omega\cdot$cm or more.

The pattern is formed by irradiation of beams.

The beam is not limited, and can be suitably selected according to the object. Examples of the beam may be laser beams, plasma jet beams, ion beams, electron beams, cluster ion beams, etc.

Examples of the laser beams may be eximer laser, $CO_2$ laser, ArF laser, KrF laser, XeCl laser, etc.

Examples of the plasma jet beams may be microwave discharging plasma, high frequency discharging plasma, ECR plasma, etc.

Preferred examples of the ion beams may be those emitted by a hot cathode ion gun, an electron cyclotron ion gun, a duo-plasma ion gun, etc.

Examples of the cluster ion beams may be cluster ion beams obtainable by evaporating a solid substance by heating at an ordinary temperature, and then emitting the evaporated substance from a nozzle to generate cluster, gas cluster ion beams obtainable by evaporating a gaseous substance (argon, carbonic acid gas, gaseous oxygen, $B_{10}H_{14}$, $SF_6$, etc.) by heating, and then emitting the evaporated gaseous substance from a nozzle to generate cluster, etc.

Conditions for irradiating beams are not limited, and can be suitably selected according to the object. The beams can be irradiated by using conventional devices and so on.

In the second embodiment, the pattern is bonded to the bonding sites of the rod-shaped organic molecules described in the first embodiment. The bonding is performed in the same manner as in the first embodiment. As a result, a circuit comprising the electroconductive molecules similar to that described in the first embodiment is formed.

{Third Embodiment}

In the third embodiment, a layer of rod-shaped organic molecules is formed on the substrate which was described in the first embodiment.

Each of the rod-shaped organic molecules carries an electroconductive material as described in the first embodiment. The electroconductive material which has already been described in the first embodiment may be used.

In the third embodiment, portions other than the portion of the abovementioned layer on which a pattern is to be formed are removed by etching. The method of etching is not limited, and may properly be selected from conventional methods. As a result, the layer of rod-shaped organic molecules lies as a pattern, and thus a circuit comprising the electric molecules carried by the rod-shaped organic molecules is formed in the same manner as described in the first embodiment.

{Fourth Embodiment}

In the fourth embodiment, a pattern is formed on the substrate described in the first embodiment.

The pattern is formed by disposing targets of capture that can be captured by capturing structural elements. The method for forming the pattern of the targets of capture on the substrate is not limited, and may properly be selected. For example, there may preferably be employed the lithography described in the first embodiment, the beam irradiation described in the second embodiment, a printing method such as ink jet printing, a coating method, a vapor deposition method, a sputtering method, etc.

In the fourth embodiment, the capture targets in the rod-shaped organic molecules are captured by the capturing structural elements. The capturing can be performed in the same manner as in the first embodiment. As a result, a circuit comprising the electroconductive molecules is formed in the same manner as in the first embodiment.

Each of the rod-shaped organic molecules carries the electroconductive material and is as described in the first embodiment, except that each of the rod-shaped organic molecules has the capturing structural element that can capture the target of capture. The electroconductive material is as described in the first embodiment.

The capturing structural elements and the targets of capture are the same as described in the preceding "Molecular Electric Wire" of the present invention.

{Fifth Embodiment}

In the fifth embodiment, a pattern of an electro-static latent image is formed on a photosensitive substrate.

The photosensitive substrate may be one having photosensitivity among those described in the first embodiment, and can properly be selected from those made from the same material as that used in a conventional photosensitive drum. Examples of the photosensitive substrate may be a zinc oxide photosensitive material, an organic photoconductor such as selenium and a selenium alloy, cadmium sulfide, polyvinyl carbazole, a complex multilayered photosensitive material, etc.

An electrostatic latent image can be formed by means of a conventional electrophotographic method, ionograph method or like methods. It is preferable to employ a method equivalent to the electrophotographic method and, specifically, the latent image may preferably be formed by charging the photosensitive substrate by using a static charger and then exposing the substrate to light by using an exposing device.

The static charger is not limited, and may suitably be selected according to the purpose. For example, the static charger may be a corotron and a scorotron using the corona discharge mechanism, a contact charge roller and a contact charge brush using the contact charge mechanism, etc.

The type of exposing device is not limited, and can be properly selected to suit the purpose. Examples of the exposing device may be a generic photocopy system using a fluorescent lamp, etc., a semiconductor laser optical system, LED optical system, printer light source using a liquid crystal shutter optical system, etc.

Next, in the fifth embodiment, the bonding sites of the rod-shaped organic molecules described in the first embodiment are bonded to the pattern. The bonding can be performed in the same manner as in the first embodiment. As a result, the electrostatic latent image is developed and, thus, a circuit comprising the electroconductive molecules is formed in the same manner as in the first embodiment.

Each of the rod-shaped organic molecules carries the electroconductive material and is as described in the first embodiment. The electroconductive material is as described in the first embodiment.

{Sixth Embodiment}

In the sixth embodiment, either a hydrophilic pattern or a hydrophobic pattern is formed on the substrate which is described in the first embodiment.

The method of forming the hydrophilic pattern or the hydrophobic pattern is not limited, and can properly be selected to suit the purpose. For example, there may be employed the lithography described in the first embodiment, the method employing a beam described in the second embodiment, an etching method, sputtering method, vapor deposition method, coating method, printing method, etc., while using a hydrophilic material or a hydrophobic material.

Next, in the sixth embodiment, the rod-shaped organic molecules described in the first embodiment, which are amphiphilic molecules, are bonded to the pattern.

The bonding can be performed simply by applying the rod-shaped organic molecules on the substrate in the same manner as the first embodiment taking advantage of the self-organization. Hydrophilic portions in the rod-shaped organic molecules are aligned on the pattern due to self-organization in the case where the pattern is hydrophilic, while hydrophobic portions in the rod-shaped organic molecules are aligned on the pattern due to self-organization in the case where the pattern is hydrophobic.

Each of the rod-shaped organic molecules carries an electroconductive material and is the same as that described in the first embodiment, except that they are essentially amphiphilic. The electroconductive material is as described in the first embodiment.

Thus, a circuit comprising the electroconductive molecules is formed in the same manner as in the first embodiment. Here, the rod-shaped organic molecules are aligned in parallel while being opposed to each other across the pattern (the electroconductive materials may be present on the pattern or may be present in the rod-shaped organic molecules while being aligned in parallel while being adjacent to one another).

Hereinafter, there will be described specific examples of the molecular electric wire circuit manufactured by the process of the molecular electric wire circuit of the present invention with reference to the attached drawings.

In the molecular electric wire circuit shown in FIG. 1, a pattern is formed on a substrate. The substrate is hydrophilic, and both ends of the pattern on the substrate are surface-treated along the pattern so that hydrophobic properties are imparted thereto.

A representative example of the hydrophilic substrate is a glass substrate that has been washed with a weak alkali substance, while it is possible to use a silicon wafer that is made hydrophilic by silication by way of strong alkaline treatment, by silanol denaturation, or by absorption of a surfactant, a hydrophobic film whose surface has been made hydrophilic by a corona discharge treatment or a glow discharge treatment, etc.

In the molecular electric wire circuit, the rod-shaped organic molecules 10 each having a hydrophobic portion 10*a* at one end and a hydrophilic portion 10*b* at another end, wherein the hydrophobic portion 10*a* has an electroconductive material 12 and a bonding site that can be bonded to the pattern, are bonded to the pattern at the bonding sites. Here, since the both ends of the pattern are surface-treated to be hydrophobic and, each of the rod-shaped organic molecules 10 is positioned with the hydrophobic portion 10*a* being adjacent to the pattern and the hydrophilic portion 10*b* being away from the pattern aligned in parallel with its longitudinal direction being directed to a substantially orthogonal direction with respect to the pattern as shown in FIG. 1. In this state, the electroconductive material 12 in each of the rod-shaped organic molecules 10 is present at the end of the hydrophobic portion 10*a* and, therefore, a plurality of the electroconductive materials 12 are present along the pattern in the molecular electric wire circuit to form a circuit, and the circuit is connected to an ammeter and a electric power source so as to be electrically conductive to form the molecular electric wire circuit. Therefore, when the electric power source is switched on, the line of the electroconductive materials 12 functions as a molecular electric wire and, thus, a current flows along the line of the electroconductive materials 12 (along the pattern).

In the molecular electric wire circuit shown in FIG. 2, a pattern is formed on a substrate. In the molecular electric wire circuit, a rod-shaped organic molecule 10, which has a hydrophobic portion 10*a* at one end and a hydrophilic portion 10*b* at another end, carries an electroconductive material 12 along an internal longitudinal direction thereof and has a plurality of bonding sites that can be bonded to the pattern on a periphery thereof along the longitudinal direction, is bonded to the pattern at the bonding sites. Since the bonding sites exist on a periphery of the rod-shaped organic molecule 10 along the longitudinal direction, the plurality of the rod-shaped organic molecules 10 is aligned along the pattern when the bonding sites are bonded to the pattern. Further, since each of the rod-shaped organic molecules 10 has the hydrophobic portion 10*a* and the hydrophilic portion 10*b*, portions of the identical affinity (hydrophobic portions or hydrophilic portions) of adjacent rod-shaped organic molecules among the rod-shaped organic molecules aligned along the pattern are opposed to each other due to the self-organization as shown in FIG. 2. In this state, since the electroconductive material 12 is carried by each of the rod-shaped organic molecules 10 along the longitudinal direction, the electroconductive materials 12 are present substantially along the pattern in the molecular electric wire circuit to form a circuit. The circuit is connected to an ammeter and an electric power source as being electrically conductive to form the molecular electric wire circuit. When the electric power source is switched on, the line of the electroconductive materials 12 functions as a molecular electric wire, and a current flows along the line of the electroconductive materials 12 (along the pattern).

The molecular electric wire circuit produced by the producing method of present invention is comprised of the apparatuses that are selected properly such as an electrode assembly, an electric power source, a capacitor for energization, etc., outside the circuit of the electroconductive material.

According to the production method for the molecular electric wire circuit, it is possible to effectively produce a molecular electric wire circuit comprising a molecular electric wire that is formed of an environmentally benign ecological material and enables a microscopic wiring, for which a molecular electric wire circuit is suitably used in various fields including information technology, biotechnology, medical technology, energy technology, etc.

The following embodiments, and the like are preferred in the molecular electric wire and the molecular electric wire circuit of the present invention.

<1> A molecular electric wire comprising a rod-shaped organic molecule; and an electroconductive material carried by the rod-shaped organic molecule.

<2> The molecular electric wire according to item <1>, wherein the electroconductive material is carried by the rod-shaped organic molecule on at least one of a) an inside portion thereof, b) an end portion thereof and c) a periphery portion thereof.

<3> A molecular electric wire comprising two rod-shaped organic molecule arrays, each of which is formed of a plurality of amphiphilic rod-shaped organic molecules each having a hydrophilic end and a lipophilic end and aligned in a substantially orthogonal direction with respect to a longitudinal direction thereof, the amphiphilic rod-shaped organic molecules being arranged so that the lipophilic ends of the rod-shaped organic molecules are directed towards an identical orientation, and the rod-shaped organic molecule arrays being arranged so that one of: 1) the lipophilic ends of one of the arrays contact with the lipophilic ends of the other array; and 2) the hydrophilic ends of one of the arrays contact with the hydrophilic ends of the other array; with an electroconductive material being intervened between each pair of the contacting ends.

<4> A molecular electric wire obtainable by contacting an end of a rod-shaped organic molecule carrying an electroconductive material with an end of another rod-shaped organic molecule carrying an electroconductive material.

<5> The molecular electric wire according to item <4>, wherein each of the rod-shaped organic molecules is an amphiphilic molecule having a hydrophilic end and a lipophilic end, and both (a) the end of the rod-shaped organic molecule and (b) the end of another rod-shaped organic molecule are one of hydrophilic ends and lipophilic ends.

<6> The molecular electric wire according to item <4>, wherein the electroconductive material is intervened between the end of the rod-shaped organic molecule and the end of another amphiphilic rod-shaped organic molecule.

<7> A molecular electric wire comprising a structure formed by contacting an end of one of the amphiphilic rod-shaped organic molecules each having a hydrophilic end and a lipophilic end with an end of another one of the rod-shaped organic molecules.

<8> A molecular electric wire comprising: an electroconductive material; a rod-shaped organic molecule carrying the electroconductive material; a target of capture bonded to an end of the rod-shaped organic molecule; and a capturing structural element which is bonded to the other end of the rod-shaped organic molecule and which specifically captures the target of capture.

<9> A molecular electric wire comprising: a plurality of unit electroconductive molecules each having a rod-shaped organic molecule carrying an electroconductive material; a target of capture bonded to an end of the rod-shaped organic molecule; a capturing structural element bonded to the other end of the rod-shaped organic molecule for specifically capturing the target of capture; wherein the target of capture in one of the unit electroconductive molecules being captured by a capturing structural element of another one of the unit electroconductive molecules.

<10> The molecular electric wire according to item <8>, wherein the capturing structural element is an electroconductive material.

<11> The molecular electric wire according to item <1>, wherein the rod-shaped organic molecule is a helix molecule.

<12> The molecular electric wire according to item <11>, wherein the helix molecule is selected from α-helix polypeptide, DNA and amylose.

<13> The molecular electric wire according to item <1>, wherein the electroconductive material is at least one selected from the group consisting of a metal atom, a metal oxide, a metal sulfide, a carbon compound, an ionic compound and a halogen atom.

<14> The molecular electric wire according to item <1>, wherein the electroconductive material is a dopant used for doping an aromatic π conjugated polymer.

<15> A molecular electric wire circuit according to item <1> comprising any one of the molecular electric wires according to claim 1.

The molecular electric wire of item <1> comprises a rod-shaped organic molecule and an electroconductive material, the electroconductive material being carried by the rod-shaped organic molecule. Therefore, a current flows through the molecular electric wire by contacting an electrode with each of the ends of the molecular electric wire.

The electroconductive material of the molecular electric wire of item <2> is carried by the rod-shaped organic molecule on at least one selected from an inside portion thereof, an end portion thereof and a peripheral portion thereof according to item <1>. Therefore, a current flows effectively through the molecular electrical wire by contacting an electrode with each of the ends of the molecular electric wire.

The molecular electric wire of item <3> comprises two rod-shaped organic molecule arrays each of which is formed of a plurality of amphiphilic rod-shaped organic molecules each having a hydrophilic end and a lipophilic end and being aligned in a substantially orthogonal direction with respect to a longitudinal direction thereof, the amphiphilic rod-shaped organic molecules being arranged so that the lipophilic ends of the rod-shaped organic molecules are directed towards an identical orientation, and the rod-shaped organic molecule arrays being arranged so that either the lipophilic ends of one of the arrays contact with the lipophilic ends of the other array or the hydrophilic ends of one of the arrays contact with the hydrophilic ends of the other array with an electroconductive material being intervened between each pair of the contacting ends. Therefore, the sequence (line) of the electroconductive materials incorporated between the amphiphilic rod-shaped organic molecules functions as an electric wire, and a current flows along the sequence (line) of the electroconductive materials.

The molecular electric wire of item <4> is obtainable by contacting an end of a rod-shaped organic molecule carrying an electroconductive material with an end of another rod-shaped organic molecule carrying an electro conductive material. Therefore, a plurality of molecular electric wires are contacted with one another so as to be capable of electrical continuity, and the molecular electric wires can thus be extended.

In the molecular electric wire of item <5> , each of the rod-shaped organic molecules is an amphiphilic molecule having a hydrophilic end and a lipophilic end, and both of an end of one of the rod-shaped organic molecules and an end of another one of the rod-shaped organic molecules are either hydrophilic (hydrophobic) ends or lipophilic ends according to item <4>. Therefore, the molecular electric wire can easily be extended by bringing the hydrophilic portions of the rod-shaped organic molecules into contact or by bringing the lipophilic portions of the rod-shaped organic molecules into contact.

In the molecular electric wire of item <6>, the electroconductive material is intervened between the end of one of the rod-shaped organic molecules and the end of another one of the rod-shaped organic molecules according to item <4>. Therefore, a plurality of molecular electric wires achieve good electrical continuity without causing a large electrical resistance at the contact surfaces thereof.

The molecular electric wire of item <7> is obtainable by contacting an end of one of the amphiphilic rod-shaped organic molecules, each having a hydrophilic end and a lipophilic end, with an end of another one of the rod-shaped organic molecules. Therefore, a plurality of molecular electric wires can be brought into contact with one another so as to be capable of electrical continuity, and the molecular electric wires can thus be extended.

The molecular electric wire of item <8> comprises a rod-shaped organic molecule that carries an electroconductive material, a target of capture that is bonded to an end of the rod-shaped organic molecule, and a capturing structural element that is bonded to the other end of the rod-shaped organic molecule and which specifically captures the target of capture. Therefore, a plurality of molecular electric wires can easily be extended so as to be capable of electrical continuity by the capturing structural element in one of the molecular electric wires capturing the target of capture in another one of the molecular electric wires.

The molecular electric wire of item <9> comprises a plurality of unit electroconductive molecules each having a rod-shaped organic molecule carrying an electroconductive material, a target of capture bonded to an end of the rod-shaped organic molecule and a capturing structural element bonded to another end of the rod-shaped organic molecule for specifically capturing the target of capture, the target of capture in one of the unit electroconductive molecules being captured by the capturing structural element of another one of the unit electroconductive molecules. Therefore, a plurality of molecular electric wires can be connected to one another easily without causing breakage or the like because of sufficient bonding strengths between the unit electroconductive molecules, thereby enabling an arbitrary wiring.

In the molecular electric wire of item <10>, the target of capture is an electroconductive material according to item <8>. Therefore, the molecular electric wires achieve good electrical continuity without causing large electrical resistances at the interfaces thereof and the interfaces of the unit electroconductive molecules.

In the molecular electric wire of item <11>, the rod-shaped organic molecule is a helix molecule according to item <1>. Therefore, current flows along the helix molecules and, the molecular electric wire is suitably used as a wiring in an electric circuit.

In the molecular electric wire of item <12>, the helix molecule is selected from α-helix, DNA and amylose according to item <11>. Therefore, the molecular electric wire is usable for a microscopic wiring and excellent in safety and handling ease.

In the molecular electric wire of item <13>, the electroconductive material is at least one selected from the group consisting of a metal atom, a metal oxide, a metal sulfide, a carbon compound, an ionic compound and a halogen atom according to item <1>. Therefore, the molecular electric wire is excellent in electroconductivity.

In the molecular electric wire of item <14>, the electroconductive material is a dopant used for doping an aromatic π conjugated polymer according to item <1>. When the dopant is subjected to the doping, the positive charge is delocalized in the π conjugated system, for example; therefore, a current flows through the molecular electric wire due to the charge transfer when a voltage is applied thereto.

The electric circuit of <15> is a molecular electric wire circuit comprising any one of the molecular electric wires of item <1>. The molecular electric wire circuit does not require a large space, and enables a production of a paper-like thin display when the circuit is applied to a display and so forth.

The following embodiments are preferred as the production method of the molecular electric wire circuit of the present invention.

<16> A method for producing a molecular electric wire circuit comprising: a step for forming a pattern on a substrate by way of lithography; and a step for bonding bonding sites of rod-shaped organic molecules carrying an electroconductive material to the pattern.

<17> A method for producing a molecular electric wire circuit according to item <16>, wherein the pattern is formed of one of a material of a substrate and a resist.

<18> A method for producing a molecular electric wire circuit according to item <16>, wherein the substrate is electroconductive and the resist is insulative.

<19> A method for producing a molecular electric wire circuit according to item <16>, wherein the substrate is insulative and the resist is electroconductive.

<20> A method for producing a molecular electric wire circuit according to item <16>, wherein the resist is at least one selected from the group consisting of a negative-type resist and a positive-type resist, and the lithography is performed by employing at least one of an electron beam irradiation or exposure to light.

<21> A method for producing a molecular electric wire circuit according to item <16>, wherein the substrate is insulative, the resist is at least one selected from the group consisting of a dielectric methanofullerene, chrome, ITO and an electroconductive polymer, and the lithography is performed by employing the electron beam irradiation.

<22> A method for producing a molecular electric wire circuit comprising: a step for forming a pattern on a substrate by using irradiation beams or a step for forming a pattern on a substrate by way of lithography; and a step for bonding a bonding site of a rod-shaped organic molecules carrying an electroconductive material to the pattern.

<23> A method for producing a molecular electric wire circuit according to item <22>, wherein the beam is selected from laser beams, plasma jet beams, ion beams, electron beams and cluster ion beams.

<24> A method for producing a molecular electric wire circuit according to item <22>, wherein the volume resistivity is $1\times10^{0}\Omega$ cm or more.

<25> A method for producing a molecular electric wire circuit comprising: a step for forming a layer of rod-shaped organic molecules each carrying an electroconductive material on a substrate; and a step for removing portions other than a portion on which a pattern is to be formed by etching to form a circuit comprising an electroconductive molecules.

<26> A method for producing a molecular electric wire circuit comprising: a step for forming a pattern on a substrate by a target of capture; and a step for capturing the target of capture by the capturing structural element of the rod-shaped organic molecule carrying an electroconductive material.

<27> A method for producing a molecular electric wire circuit comprising: a step for forming an electrostatic latent image pattern on a photosensitive substrate; and a step for bonding a bonding site of rod-shaped organic molecules to the pattern carrying an electroconductive material so as to form a circuit pattern.

<28> A method for producing a molecular electric wire circuit comprising: a step for forming one of a hydrophilic pattern and a hydrophobic pattern on a substrate; and a step for bonding amphiphilic rod-shaped organic molecules each carrying an electroconductive material to the pattern.

<29> A method for producing a molecular electric wire circuit according to item <28>, wherein the substrate is a hydrophilic substrate and the pattern is hydrophobic.

<30> A method for producing a molecular electrical wire according to item <28>, wherein the substrate is a hydrophobic substrate and the pattern is hydrophilic.

<31> The method for producing a molecular electric wire circuit according to item <16>, wherein the rod-shaped organic molecules are aligned in series.

<32> The method for producing a molecular electrical wire according to item <16>, wherein the resist is a negative type resist, and the lithography is performed with respect to the resist by at least one of electron beam irradiation on or exposure to light of portions other than a portion on which the pattern is to be formed.

<33> The method for producing a molecular electrical wire according to item <16>, wherein the resist is a positive type resist, and the lithography is performed with respect to the resist by at least one of electron beam irradiation on or exposure to light of the portion on which the pattern is to be formed.

<34> The method for producing a molecular electric wire circuit according to item <16>, wherein the bonding site is at least one selected from the group consisting of a group having a hetero atom, a halogen atom and a group capable of forming a complex.

<35> The method for producing a molecular electric wire circuit according to item <34>, wherein the group having a hetero atom is a thiol group, an amino group, a phosphoric acid group, an amino group, a hydroxyl group or a carboxyl group, and the halogen atom is fluorine, chlorine, bromine or iodine.

<36> The method for producing a molecular electric wire circuit according to item <16>, wherein the pattern is formed of at least one selected from the group consisting of gold, silver, platinum, silicon and titanium oxide.

<37> The method for producing a molecular electric wire circuit according to item <22>, wherein the cluster ion beams are selected from the group consisting of cluster ion beams obtainable by evaporating a solid substance by heating at an ordinary temperature and then emitting the evaporated solid substance from a nozzle to generate cluster and gas cluster ion beams obtainable by evaporating a gaseous substance by heating and then emitting the evaporated gaseous substance from a nozzle to generate cluster, etc.

<38> The method for producing a molecular electric wire circuit according to item <16>, wherein the substrate is formed of at least one selected from the group consisting of a resin and a ceramic.

EXAMPLES

Examples of the present invention will be described below, but the invention is not limited by the Examples.

Example 1

An α-helix copolypeptide $PLLZ_{25}$-P($MLG_{42}$/$LGA_{18}$) is prepared as α-helix polypeptide, which is used as the rod-shaped organic molecule, in the manner described below. Using n-hexylamine as an initiator, a polymerization of $N^{\varepsilon}$-carbobenzoxy L-lysine $N^{\alpha}$-carboxylic acid anhydride (LLZ-NCA) is conducted, and then a polymerization of γ-methyl L-glutamate N-carboxylic acid anhydride (MLG-NCA) to obtain a block copolypeptide $PLLZ_{25}$-$PMLG_{60}$ wherein a polymerization degree of a PLLZ portion is 25 and a polymerization degree of PMLG portion is 60. After that, a part of the PMLG segments is hydrolyzed to obtain L-glutamic acid (LGA), thereby obtaining the $PLLZ_{25}$-P($MLG_{42}$/$LGA_{18}$).

Next, the $PLLZ_{25}$-P($MLG_{42}$/$LGA_{18}$) is soaked in a solution containing a cyanine dye so that the cyanine dye is carried by the $PLLZ_{25}$-P($MLG_{42}$/$LGA_{18}$) at a periphery thereof.

Thus, a molecular electric wire comprising the amphiphilic $PLLZ_{25}$-P($MLG_{42}$/$LGA_{18}$) that carries the cyanine dye on its periphery is obtained.

A plurality of molecular electric wires are aligned as shown in FIG. 1. Specifically, the molecular electric wires are aligned in such a manner that two rod-shaped organic molecule arrays each of which is formed of a plurality of amphiphilic rod-shaped organic molecules 10 each aligned in a substantially orthogonal direction with respect to a longitudinal direction thereof, the rod-shaped organic molecules 10 are arranged so that the ends of lipophilic portions 10*a* of the rod-shaped organic molecules are directed towards an identical orientation, and the arrays are arranged so that either ends of the lipophilic (hydrophobic) portions 10*a* of one of the arrays contact with the ends of the lipophilic (hydrophobic) portions 10*a* of the other array or ends of the hydrophilic portions 10*b* of one of the arrays contacts with the ends of the hydrophilic portions 10*b* of the other array with an electroconductive material 12 intervened between each pair of the ends. An electric circuit is formed by contacting an electrode that is connected to an electric power source for energization to each of the ends of a line formed by the electroconductive materials 12. An ammeter is connected to a part of the electric circuit, and then the electric power source is switched on to energize a current of 100 mV to confirm that a current of 40 μA is flowing through the molecular electric wire circuit.

Example 2

Molecular electric wires are prepared by causing the rod-shaped organic molecules prepared in Example 1 to carry the cyanine dye at its periphery in the same manner as Example 1, and then the molecular electric wires are connected and fixed as a line as shown in FIG. 2 on a substrate. Specifically, an end of a lipophilic (hydrophobic) portion 10*a* of one of the amphiphilic rod-shaped organic molecules 10 is contacted with an end of a lipophilic (hydrophobic) portion 10*a* of another one of the amphiphilic rod-shaped organic molecules 10 and an end of a hydrophilic portion 10*b* of one of the amphiphilic rod-shaped organic molecules 10 is contacted with an end of a lipophilic portion 10*b* of still another one of the amphiphilic rod-shaped organic molecules 10, thereby extending the length of the molecular electric wires. Then, an electric circuit is formed by contacting an electrode that is connected to an electric power source for energization to each of the ends of the extended molecular electric wires. An ammeter is connected to a part of the electric circuit, and then the electric power source is switched on to energize a current of 100 mV to confirm that a current of 20 μA is flowing through the molecular electric wire circuit.

Example 3

After causing the rod-shaped organic molecules prepared in Example 1 to carry the cyanine dye at its periphery in the same manner as Example 1, iodine is bonded to an end of the rod-shaped organic molecules as the target of capture and cyclodextrin is bonded to the other end as the capturing structural element to obtain a molecular electric wire.

A plurality of molecular electric wires are connected and fixed in a line on a substrate as shown in FIG. 3. Particularly, the iodine of the rod-shaped organic molecules 10 with iodine as the target capture 3 bonded an end thereof and cyclodextrin as the capturing structural element 2 connected to another end thereof is captured by the cyclodextrin of another rod-shaped organic molecules 10 with iodine as the target capture 3 bonded to an end thereof and cyclodextrin as the capturing structural element 2 connected to another end thereof, and with both ends of the molecular electric wires thus extended, an electrode that is connected to an electric power source for energization is brought into contact, thus an electric circuit is formed. An ammeter is connected to a part of the electric circuit, and then the electric power source is switched on to energize a current of 100 mV, thereby to confirm that a current of 20 μA is flowing through the molecular electric wire circuit.

Example 4

After causing the rod-shaped organic molecules prepared in Example 1 to carry the cyanine dye at its periphery in the same manner as Example 1, a thymine pentamer TTTTT is bonded to an end of the rod-shaped organic molecule as the target of capture and a guanine pentamer GGGGG is bonded to the other end as the capturing structural element to obtain a molecular electric wire. Further, another molecular electric wire is obtained by causing the rod-shaped organic molecules prepared in Example 1 to carry the cyanine dye at its periphery in the same manner as Example 1 and then bonding an adenine pentamer AAAAA to an end of the rod-shaped organic molecules as the target of capture and bonding a cytosine pentamer CCCCC to the other end as the capturing structural element.

The two types of molecular electric wires are aligned and fixed in a line on a substrate as shown in FIG. 3. Specifically, the guanine pentamer GGGGG in the rod-shaped organic molecules 10, to which the thymine pentamer TTTTT is bonded to an end of the rod-shaped organic molecules 10 as the target of capture 3 and the guanine pentamer GGGGG is bonded to the other end as the capturing structural element 2, is complementarily bonded to the cytosine pentamer CCCCC in the rod-shaped organic molecules 10, to which the adenine pentamer AAAAA is bonded to an end of the rod-shaped organic molecules 10 as the target of capture 3 and the cytosine pentamer CCCCC is bonded to the other end as the capturing structural element 2, while the thymine pentamer TTTTT of one of the rod-shaped organic molecules 10 is complementarily bonded to the adenine pentamer AAAAA, which is the capturing structural element 2, in still another rod-shaped organic molecule 10 to make an extension. And then an electric circuit is formed by contacting an electrode that is connected to an electric power source for energization to each of the ends of the molecular electric wires thus extended. An ammeter is connected to a part of the electric circuit, and then the electric power source is switched on to energize a current of 100 mV to confirm that a current of 20 μA is flowing through the molecular electric wire circuit.

Example 5

After forming a molecular electric wire by causing the rod-shaped organic molecule prepared in Example 1 to carry the cyanine dye at its periphery in the same manner as Example 1, the obtained α-helix copolypeptide $PLLZ_{25}$-P($MLG_{42}$/$LGA_{18}$) is reacted directly with halogenated alkylthiol under a weak basicity to introduce a thiol group into an end of poly L-lysine portion ($PLLZ_{25}$), which is a hydrophilic portion.

A plurality of amphiphilic α-helix copolypeptides $PLLZ_{25}$-P($MLG_{42}$/$LGA_{18}$) are applied on a substrate on which a pattern of a metal atom was formed by using an ion beam gun and both sides thereof are subjected to a surface treatment to become hydrophobic. Then, the metal atom forming the pattern and the thiol groups in the amphiphilic α-helix copolypeptides $PLLZ_{25}$-P($MLG_{42}$/$LGA_{18}$) are bonded. The substrate is then washed with water, so that the amphiphilic α-helix copolypeptides $PLLZ_{25}$-P($MLG_{42}$/$LGA_{18}$) that are not bonded to the metal atom are removed from the substrate. The amphiphilic α-helix copolypeptide $PLLZ_{25}$-P($MLG_{42}$/$LGA_{18}$) are positioned on the substrate with the hydrophobic portions being adjacent to the pattern and with the hydrophilic portions being away from the pattern and aligned with the longitudinal direction being directed to a substantially orthogonal direction with respect to the pattern.

In a molecular electric wire circuit thus formed, both ends of the pattern are connected to an ammeter and an electric power source. When the electric power source is switched on to provide a current of 100 mV, it is confirmed that the line of the electroconductive material 12 functioned as a molecular electric wire and a current of 40 μA is flowing along the line of the electroconductive materials 12 (along the pattern).

Example 6

A molecular electric wire circuit is formed in the same manner as Example 5, except for introducing a plurality of thiol groups into the amphiphilic α-helix copolypeptides $PLLZ_{25}$-P($MLG_{42}$/$LGA_{18}$) on the periphery along the longitudinal direction thereof.

Since the amphiphilic α-helix copolypeptide $PLLZ_{25}$-P($MLG_{42}$/$LGA_{18}$) each have a hydrophobic portion and a hydrophilic portion, the portions of the same affinity (hydrophobic portions or hydrophilic portions) of the adjacent rod-shaped organic molecules among those aligned along the pattern are opposed to each other. When the electric power source is switched on to provide a current of 100 mV to the thus formed molecular electric wire circuit, it is confirmed that the line of the electroconductive material 12 functioned as a molecular electric wire and a current of 20 μA is flowing along the line of the electroconductive materials 12 (along the pattern).

Example 7

A molecular electric wire circuit is formed in the same manner as Example 5, except for forming a pattern using an iodine atom, which is a target of capture, in place of the metal atom and using cyclodextrin, which is a capturing structural element, in place of the thiol group.

In the molecular electric wire circuit, the amphiphilic α-helix copolypeptides $PLLZ_{25}$-P($MLG_{42}$/$LGA_{18}$) are aligned and fixed on a substrate along the pattern by way of the cyclodextrin capturing the iodine atom, not by way of the bond between the metal atom and the thiol group. When the electric power source is switched on to provide a current of 100 mV to the thus formed molecular electric wire circuit, it is confirmed that the line of the electroconductive material 12 functioned as a molecular electric wire and a current of 20 μA is flowing along the line of the electroconductive materials 12 (along the pattern).

Example 8

A molecular electric wire circuit is formed in the same manner as in Example 5 except for forming a pattern using a thymine pentamer TTTTT, which is a target of capture, in place of the metal atom and using an adenine pentamer AAAAA, which is a capturing structural element, in place of the thiol group.

In the molecular electric wire circuit, the amphiphilic α-helix copolypeptides $PLLZ_{25}$-P($MLG_{42}$/$LGA_{18}$) are aligned and fixed on a substrate along the pattern by way of the adenine pentamer AAAAA capturing the thymine pentamer TTTTT, not by way of the bond between the metal atom and the thiol group. When the electric power source is switched on to provide a current of 100 mV to the thus formed molecular electric wire circuit, it is confirmed that the line of the electroconductive material 12 functioned as a molecular electric wire and a current of 20 μA is flowing along the line of the electroconductive materials 12 (along the pattern).

What is claimed is:

1. A molecular electric wire comprising:

a plurality of rod-shaped organic molecules, each of which has a helical structure and is selected from the group consisting of α-helix polypeptide and amylose; and an electroconductive material carried by the rod-shaped organic molecule, wherein the plurality of rod-shaped organic molecules are linearly aligned.

2. A molecular electric wire according to claim 1, wherein the electroconductive material is carried by the rod-shaped organic molecule on at least one of a) an inside portion of the rod-shaped organic molecule, b) an end portion of the rod-shaped organic molecule and c) a periphery portion of the rod-shaped organic molecule.

3. A molecular electric wire according to claim 1, wherein the molecular electric wire is obtainable by contacting an end of a rod-shaped organic molecule carrying an electroconductive material with an end of another rod-shaped organic molecule carrying an electroconductive material.

4. A molecular electric wire according to claim 3, wherein each of the rod-shaped organic molecules is an amphiphilic molecule having a hydrophilic end and a lipophilic end, and both (a) the end of the rod-shaped organic molecule and (b) the end of another rod-shaped organic molecule are one of hydrophilic ends or lipophilic ends.

5. A molecular electric wire according to claim 3, wherein the electroconductive material is intervened between the end of the rod-shaped organic molecule and the end of another amphiphilic rod-shaped organic molecule.

6. A molecular electric wire according to claim 1, wherein the plurality of rod-shaped organic molecules are amphiphilic, and wherein the molecular electric wire comprises a structure formed by contacting an end of one amphiphilic rod-shaped organic molecule having a hydrophilic end and a lipophilic end, with an end of another rod-shaped organic molecule having a hydrophilic end and a lipophilic end.

7. A molecular electric wire according to claim 1, wherein the electroconductive material is at least one material selected from the group consisting of a metal atom, a metal oxide, a metal sulfide, a carbon compound, an ionic compound and a halogen atom.

8. A molecular electric wire according to claim 1, wherein the electroconductive material is a dopant used for doping an aromatic π conjugated polymer.

9. A molecular electric wire circuit comprising the molecular electric wire according to claim 1.

* * * * *